US012729517B2

(12) United States Patent
Souissi

(10) Patent No.: US 12,729,517 B2
(45) Date of Patent: Sep. 8, 2026

(54) SYSTEM AND METHOD FOR EVAPORATIVE LOSS COMPENSATION AND WATER STORAGE SYSTEM FOR SWIMMING POOLS

(71) Applicant: Rayane Souissi, San Diego, CA (US)

(72) Inventor: Rayane Souissi, San Diego, CA (US)

( * ) Notice: Subject to any disclaimer, the term of this patent is extended or adjusted under 35 U.S.C. 154(b) by 305 days.

(21) Appl. No.: 18/329,850

(22) Filed: Jun. 6, 2023

(65) Prior Publication Data

US 2024/0410139 A1 Dec. 12, 2024

(51) Int. Cl.
*E03B 1/04* (2006.01)
*E04H 4/12* (2006.01)

(52) U.S. Cl.
CPC ..... *E03B 1/041* (2013.01); *E04H 4/1209* (2013.01); *E03B 2001/045* (2013.01); *E03B 2001/047* (2013.01)

(58) Field of Classification Search
CPC ... E04H 4/1209; E04H 4/1218; E04H 4/1227; E04H 4/1245; E03B 1/041; E03B 1/042; E03B 2001/045; E03B 2001/047
See application file for complete search history.

(56) References Cited

U.S. PATENT DOCUMENTS 3,660,957 A * 5/1972 Schankler ..... E04H 4/0012 52/741.12
3,908,206 A * 9/1975 Grewing ..... F16K 31/26 137/426
4,997,558 A * 3/1991 Baker ..... E04H 4/1209 210/143
5,790,991 A * 8/1998 Johnson ..... E04H 4/12 137/423
8,141,584 B1 3/2012 Ellyson et al.
8,209,794 B1 * 7/2012 Harrison ..... G05D 9/12 340/618
9,637,941 B2 * 5/2017 Bright ..... F04B 49/06
11,015,359 B2 * 5/2021 MacDonald ..... E04H 4/1218
2014/0231328 A1 8/2014 Sheehy

FOREIGN PATENT DOCUMENTS

AU 2014321130 B2 3/2015
GB 2490381 A 10/2012
WO 2012082888 A2 6/2012
WO 2013045673 A1 4/2013
WO 2014167556 A1 10/2014

* cited by examiner

*Primary Examiner* — Erin Deery
(74) *Attorney, Agent, or Firm* — Pablo Meles

(57) ABSTRACT

A method and system for pool water flow and storage for a swimming pool includes a water level sensor for measuring threshold levels for a maximum evaporation level and a maximum overflow level, a first storage tank, and a water pump. The system can further include a second storage tank, where the automatic water level control system is programmed to send signals to pump water from the first storage tank to the pool when the water level sensor detects a water level at or below the maximum evaporation level, send signals to pump water from the swimming pool to the first storage tank when the water level sensor detects a water level at or above a maximum overflow level, and send signals to pump water from a second storage tank to the first storage tank when the water level sensor in the first storage tank falls below a predetermined threshold.

20 Claims, 5 Drawing Sheets

100

200

300

400

500

SYSTEM AND METHOD FOR EVAPORATIVE LOSS COMPENSATION AND WATER STORAGE SYSTEM FOR SWIMMING POOLS

FIELD

The present disclosure relates to swimming pool water conservation, specifically an integrated system designed to reduce water evaporation and provide storage for excess water in high-heat environments.

BACKGROUND

In high-heat environments, swimming pools can lose significant amounts of water due to evaporation, leading to increased water costs for pool owners. Water loss or evaporation is a particularly pressing issue in areas with high water prices and limited water resources. A swimming pool may lose about 5 cm of water per week during the summer months. In Southern California, home owners may spend thousands of dollars to refill their swimming pools every summer season, especially when the water costs ramp up during droughts.

SUMMARY

In some embodiments, an integrated pool water flow and storage system for a swimming pool can include a water level sensor for measuring at least threshold levels for a maximum evaporation level and for a maximum overflow level for water in the swimming pool, a first water storage tank operatively coupled to the swimming pool, the first water storage tank having a water level sensor for measuring a water level in the first water storage tank, and a water pump operatively coupled to the first water storage tank. The system can further include a second water storage tank operatively coupled to the swimming pool via the water pump and an automatic water level control system operatively coupled to the water level sensor and the water pump, where the automatic water level control system includes one or more processors coupled to memory having computer instructions stored therein. When the one or more processors execute the computer instructions, the one or more processors causes the one or more processors to perform one or more operations. In some embodiments, the one or more processors can send signals to the water pump to pump water from the first water storage tank to the pool when the water level sensor detects a water level at or below the maximum evaporation level, send signals to the water pump to pump water from the swimming pool to the first water storage tank when the water level sensor detects a water level at or above a maximum overflow level, and send signals to the water pump to pump water from second water storage tank to the first water storage tank when the water level sensor in the first storage tank falls below a predetermined threshold.

In some embodiments, the second water storage tank is arranged and constructed to receive water from a rooftop of an adjacent housing structure or from excess irrigation.

In some embodiments, the second water storage tank is arrange and constructed to receive water from household wastewater sources.

In some embodiments, the system further includes a filtration system and analyzer coupled between the second water storage tank and the water pump and where the one or more processors is further programmed to send a signal to the water pump to pump water from the second water storage tank when the water level sensor in the first storage tank falls below a predetermined threshold and the analyzer detects that the water quality is above a predetermined threshold.

In some embodiments, the system further includes a filtration system and analyzer coupled between the second water storage tank and the water pump and where the one or more processors is further programmed to send a signal to the water pump to pump water from the second water storage tank to a filtered water tank when the water level sensor in the first storage tank falls below a predetermined threshold and the analyzer detects that the water quality in the second water storage tank is above a predetermined threshold.

In some embodiments, the system further includes a filtration system and analyzer coupled between the second water storage tank and the water pump and where the one or more processors is further programmed to send a signal to the water pump to divert water from the second water storage tank to a sewage pipe when the analyzer detects that the water quality in the second water storage tank is below a predetermined threshold.

In some embodiments, the system further includes a network connection for retrieving weather conditions, soil humidity level, and historical evaporation levels to intelligently analyze and manage water flow between the swimming pool, the first water storage tank, and the second water storage tank.

In some embodiments, the system further includes a filtration system and analyzer coupled between the second water storage tank and the water pump and where the one or more processors is further programmed to send a signal to the water pump to pump water from the second water storage tank when the water level sensor in the first storage tank falls below a predetermined threshold and the analyzer detects that the water quality is above a predetermined threshold.

In some embodiments, the system further includes a filtration system and analyzer coupled between the second water storage tank and the water pump and where the one or more processors is further programmed to send a signal to the water pump to pump water from the second water storage tank to a filtered water tank when the water level sensor in the first storage tank falls below a predetermined threshold and the analyzer detects that the water quality in the second water storage tank is above a predetermined threshold.

In some embodiments, the system further includes a filtration system and analyzer coupled between the second water storage tank and the water pump and where the one or more processors is further programmed to send a signal to the water pump to divert water from the second water storage tank to a sewage pipe when the analyzer detects that the water quality in the second water storage tank is below a predetermined threshold.

In some embodiments, the first water storage tank is integrated and constructed underneath the swimming pool to retain excess water from rain collected by the pool to later compensate for water evaporation.

In some embodiments, the system in a rainy season mode stores excess water in at least one of the first water storage tank and the second water storage tank.

In some embodiments, the system in a dry season manages water between the swimming pool, an irrigation system, and household usage based on weather conditions, soil humidity and preset priorities.

In some embodiments, an integrated pool water flow and storage system for a swimming pool can include a water level sensor for measuring at least threshold levels for a maximum evaporation level and for a maximum overflow level for water in the swimming pool, a first water storage tank operatively coupled to the swimming pool where the first water storage tank is arrange and constructed underneath the swimming pool, a water pump operatively coupled to the first water storage tank, a second water storage tank operatively coupled to the swimming pool via the water pump, and an automatic water level control system operatively coupled to the water level sensor and the water pump, where the automatic water level control system includes one or more processors coupled to memory having computer instructions stored therein. When executing the computer instructions, the one or more processors can causes the one or more operations including sending signals to the water pump to pump water from the first water storage tank to the pool when the water level sensor coupled to the swimming pool detects a water level at or below the maximum evaporation level and sending signals to the water pump to pump water from the swimming pool to the first water storage tank when the water level sensor coupled to the swimming pool detects a water level at or above a maximum overflow level.

In some embodiments, the first water storage tank further includes a water level sensor for measuring a water level in the first water storage tank.

In some embodiments, the one or more processors are further programmed to send signals to the water pump to pump water from second water storage tank to the first water storage tank when the water level sensor in the first storage tank falls below a predetermined threshold.

In some embodiments, the system further includes a filtration system and analyzer coupled between the second water storage tank and the water pump and where the one or more processors is further programmed to send a signal to the water pump to pump water from the second water storage tank when the water level sensor in the first storage tank falls below a predetermined threshold and the analyzer detects that the water quality is above a predetermined threshold.

In some embodiments, the system further includes a filtration system and analyzer coupled between the second water storage tank and the water pump and where the one or more processors is further programmed to send a signal to the water pump to pump water from the second water storage tank to a filtered water tank when the water level sensor in the first storage tank falls below a predetermined threshold and the analyzer detects that the water quality in the second water storage tank is above a predetermined threshold.

In some embodiments, the system further includes a filtration system and analyzer coupled between the second water storage tank and the water pump and where the one or more processors is further programmed to send a signal to the water pump to divert water from the second water storage tank to a sewage pipe when the analyzer detects that the water quality in the second water storage tank is below a predetermined threshold.

In some embodiments, the system further comprises a network connection for retrieving weather conditions, soil humidity level, and historical evaporation levels to intelligently analyze and manage water flow between the swimming pool, the first water storage tank, and the second water storage tank and further includes at least one or more wireless transceivers for transmitting data among the water level sensor or sensors, the automatic water level control system, and analyzer or analyzers.

In some embodiments, a method of evaporative loss compensation and water storage for a swimming pool having an automatic water level control system operatively coupled to a water level sensor for the swimming pool and a water pump, can include an automatic water level control system having one or more processors coupled to memory having computer instructions stored therein which when executed by the one or more processors causes the one or more processors to perform certain operations. Such operations can include sending signals to the water pump to pump water from a first water storage tank to the swimming pool when the water level sensor detects a water level at or below a maximum evaporation level, sending signals to the water pump to pump water from the swimming pool to the first water storage tank when the water level sensor detects a water level at or above a maximum overflow level, and sending signals to the water pump to pump water from a second water storage tank to the first water storage tank when the water level sensor in the first storage tank falls below a predetermined threshold.

In some embodiments, the method can further include sending a signal to the water pump to pump water from the second water storage tank to a filtered water tank when the water level sensor in the first storage tank falls below a predetermined threshold and a water quality analyzer detects that the water quality in the second water storage tank is above a predetermined threshold. In some embodiments, the method sends a signal to the water pump to divert water from the second water storage tank to a sewage pipe when the analyzer detects that the water quality in the second water storage tank is below a predetermined threshold.

DETAILED DESCRIPTION

Figure 1:
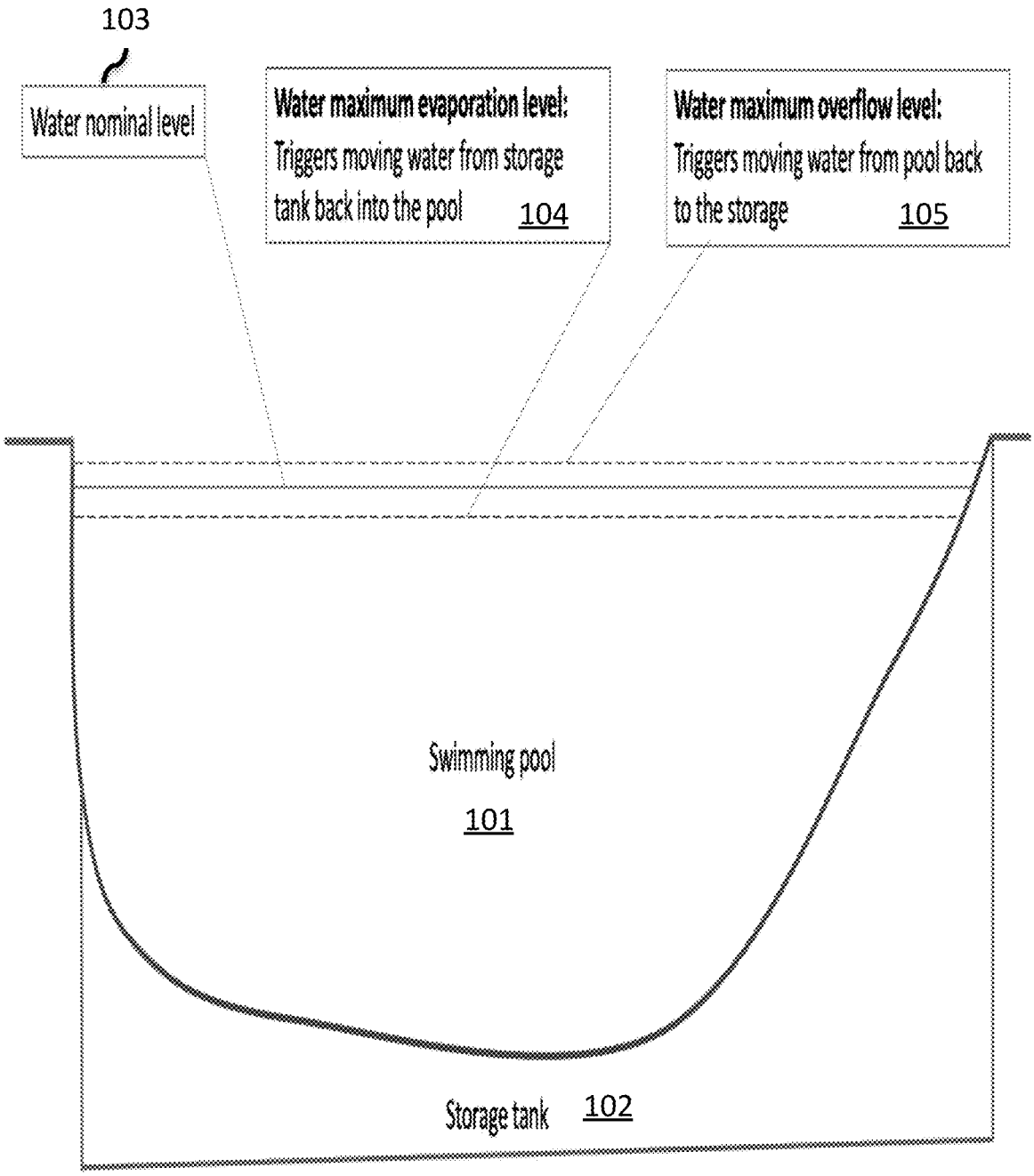
FIG. 1 illustrates an integrated pool water flow and storage system in accordance with the embodiments.
Figure 2:
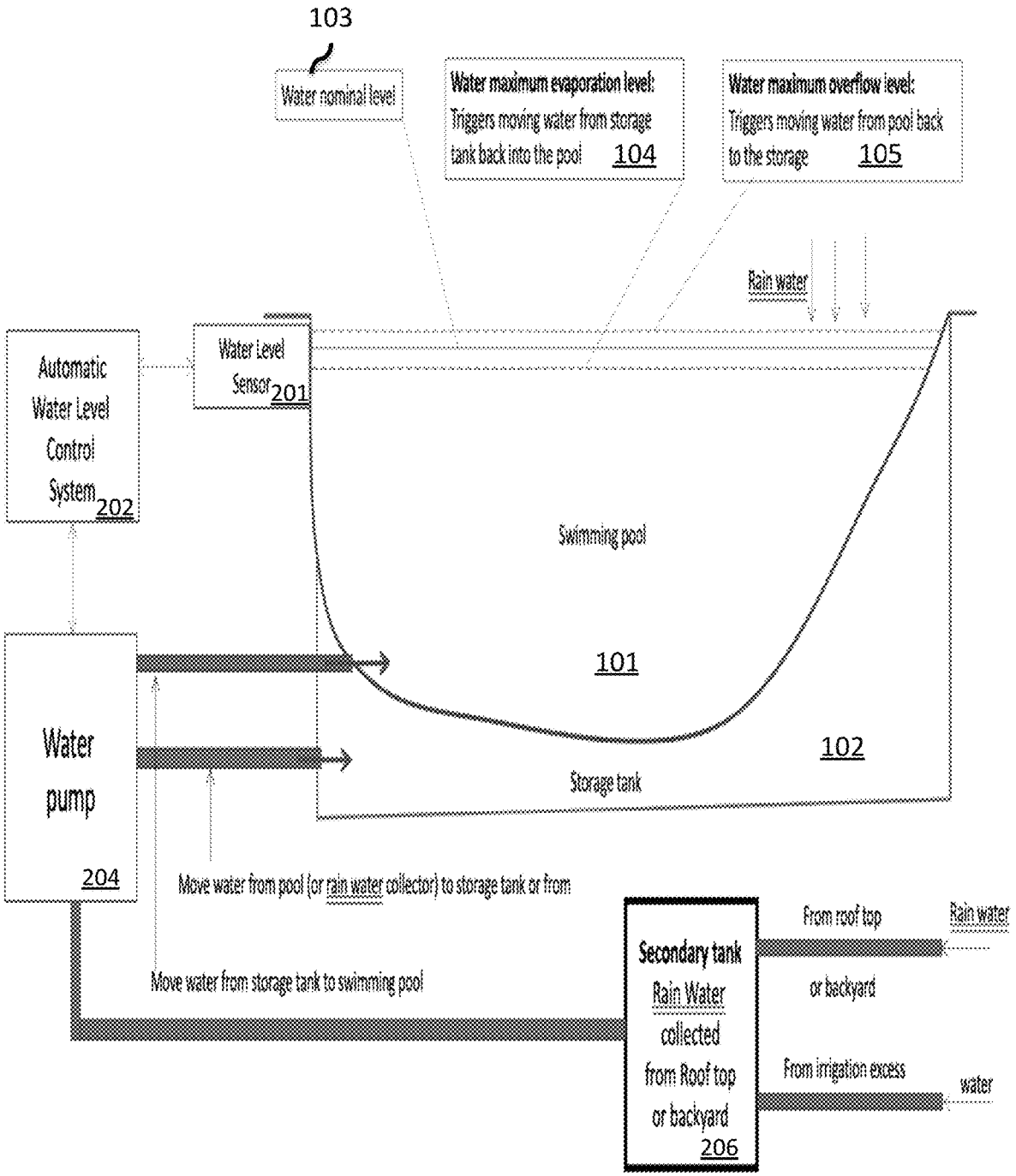
FIG. 2 illustrates a block diagram of the integrated pool water flow and storage system of FIG. 1 in further detail in accordance with the embodiments.
Figure 3:
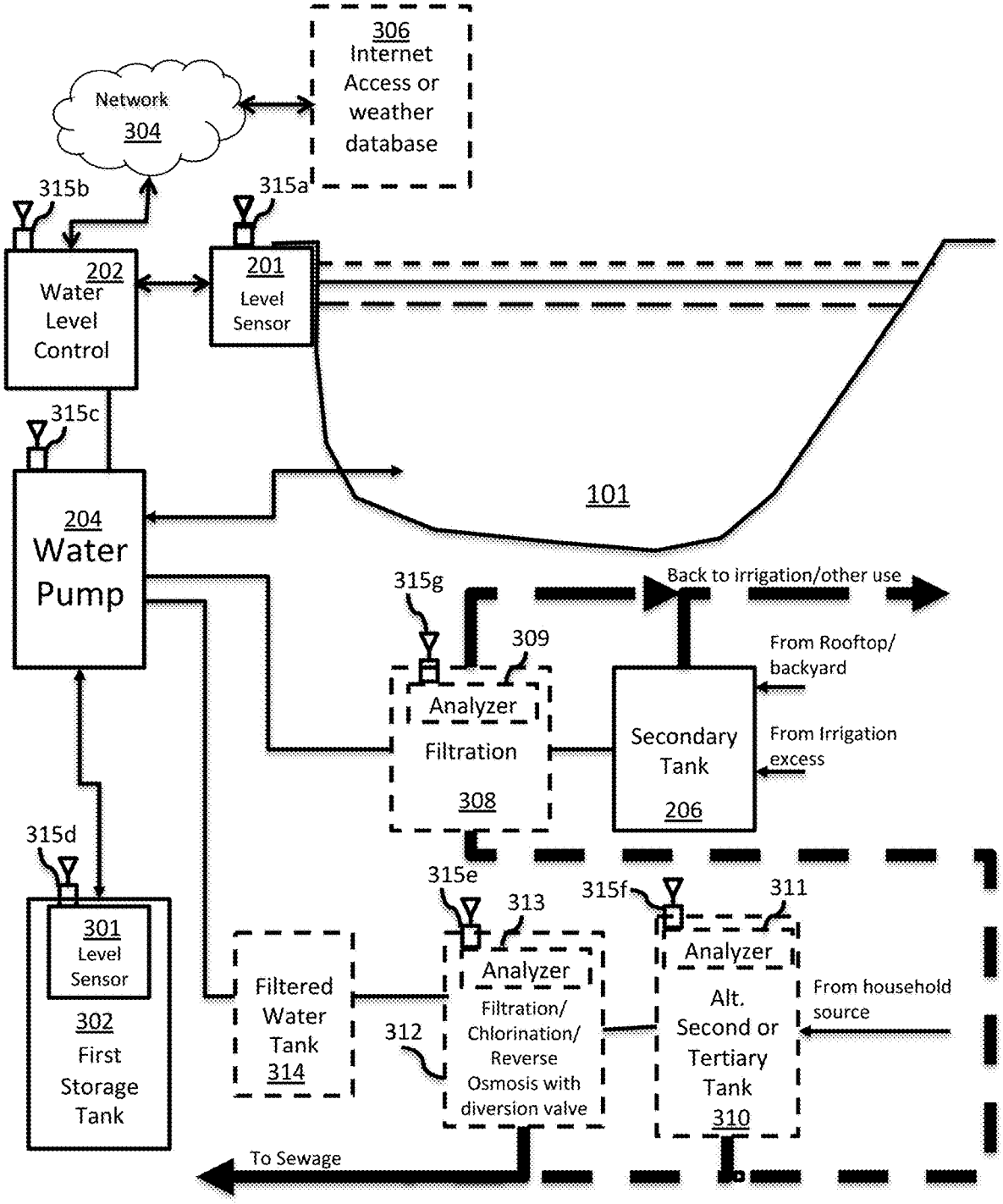
FIG. 3 illustrates another block diagram of an integrated pool water flow and storage system in accordance with the embodiments.

The claimed embodiments aim to address the problem of pool water loss and replenishment by providing a water storage and monitoring system to compensate for evaporated waters in swimming pools. In some embodiments, a system 100 as illustrated in FIG. 1, can include a swimming pool 101 and a storage tank 102 that can be integrally built underneath the swimming pool 101 (as shown in FIGS. 1 and 2) or set apart from the pool as illustrated in FIG. 3. Generally, such a system will have a means of measuring a nominal water level 103 (or normal water level), a maximum evaporation level 104, and a maximum overflow level 105. The maximum evaporation level 104 can trigger moving water from one or more storage tanks back into the swimming pool 101. The maximum overflow level can trigger moving water from the pool back to the one or more storage tanks.

With reference to FIG. 2, a system 200 similar to system 100 can include three primary components such as a pool water level sensor 201, an underground or other water storage tank 102 beneath the pool or elsewhere, and an automatic water level control system to make sure the water level within the pool remains unchanged or within certain prescribed tolerance levels regardless of weather conditions or of household water usage such as waste water from bathtubs, showers, sinks, and elsewhere within or adjacent to a home.

Referring again to FIG. 2, in some embodiments, the underground water storage tank 102 can be located directly beneath the pool and connected to the pool's water circulation system. The tank 102 can be designed to store excess pool water, which can be used for topping off the pool when evaporation causes the water level to drop in the swimming pool as measured by the water level sensor 201. This excess water can be collected from rainfall during the rainy season, pool backwashing, or other suitable sources. The storage tank 102 (or other secondary tanks) can be equipped with a filtration and disinfection system to ensure the stored water remains clean and safe for use in the pool. The stored water can be collected directly from excess water in the pool or from a network of pipes that collect rain water from a house roof or backyard and direct it to the storage tank. The water could also be collected from excess backyard irrigation water and directed to the storage tank. In some embodiments, the roof top water and/or backyard water can be initially directed and stored in a secondary tank 206, optionally analyzed and filtered, and then pumped via a water pump 204 into the primary storage tank 102 or directly back to the swimming pool as needed based on water level measurements and water quality measurement that can be made at various components of such a system. Note that although a single pump 204 is shown, a system with a secondary tank and filtration systems may require additional pumps and valves to direct water flow as desired. The single pump 204 shown is illustrated for ease of understanding and it should be understood that additional components may be required depending on the configuration or arrangement of the system. In certain instances, gravity or existing differentials in pressure can be used advantageously to avoid having to use additional pumps.

The water storage tank 102 can be coupled or connected to the water pump 204 to allow water to flow or move back and forth between the swimming pool 101 and the storage tank 102. When the water level inside the pool exceeds the normal level because of rainfall, the water Level sensor 201 sends a signal to the water pump 204 causing the pump 204 to start moving water from the pool 101 into the storage tank 102 until the water level is within the required pool level or tolerance level. On the other hand, during a hot and dry season, as the water starts to evaporate, the sensor 201 will likely detect a water shortage in the pool 101 and activate the pump 204 to start moving water from the storage tank 102 back into the pool 101. If the storage water is designed to have an average depth of 1 meter, it will allow to compensate for water evaporation for up to approximately 20 weeks, which would easily compensate for the entire evaporation of the hot, dry season (in most environments) and can contribute to saving thousands of dollars.

The embodiments herein can also be used to direct excess storage water for usage in the house or for irrigation in situations where pool water evaporation is not an issue and water levels exceed capacity levels within storage tanks.

Referring again to FIG. 2, the automatic water level control system 202 can monitor the water level in the swimming pool 101 and the storage tank 102. When the pool water level drops below a predetermined threshold due to evaporation, the control system 202 can automatically transfer water from the storage tank 102 to the pool 101 to maintain the desired water level. Conversely, if the water level in the pool 101 rises above a predetermined threshold due to rainfall or other sources, the excess water can be directed to the storage tank 102.

Referring to another water storage and monitoring system 300 as shown in FIG. 3, in some embodiments, water collected from the showers, baths, sinks that is "semi-clean" can be collected in secondary tank 206 or other separate or alternative tank or separate reservoir 310. The tank 206 or 310 can be filtered and analysed with a processing unit that can hold a predetermined volume or amount of water, such as approximately 10 gallons. If the 10 gallon held capacity is tested to be fully clean, then the clean water is moved to the first or primary water storage tank 302 (or the storage tank 102 underneath the pool shown in FIGS. 1 and 2). If that water is analysed and found unclean, then such unclean water can be directed to the sewage pipes. They system can have a cyclic process where during every cycle, 10 gallons (or other predetermined amount) of home water is analysed and directed to the pool tank only if they pass a chemical purity test or other water quality test.

In one embodiment, the predetermined volume (e.g., 10 gallons) can be in a separate filtration container 308 where it is filtered and analyzed with a water analyzer 309. In some embodiments, the container 308 with filtration and analyzer 309 can be all within the secondary tank 206. In some embodiments, one secondary tank can be used for receiving rooftop and backyard water as well as water from excess irrigation and can further receive the household water from showers, baths and sinks. In yet other embodiments, separate tanks, filtration, and analyzers (see analyzers 309, 311, and 313 and tanks 206, 308, 310, and 312) as shown in FIG. 3 can be used to advantageously separately analyze and filter for expected sediments, wastes, and pollutants as might be expected from different sources such as from a rooftop source versus from household waste water source. In some embodiments, a separate tank 314 can temporarily hold filtered water as shown before pumping such water to the pool 101 or re-circulated back to a home for other purposes assuming sufficient water quality.

In some embodiments, the system 300 can be intelligent and have various components that manage water flow between tank, pool, irrigation system and home. The system can use a series of processors, water level sensors (e.g., 201), and wireless data transceivers or IoT transceivers 315*a-g* to enable such intelligent management of water flow. In some embodiments, the system 300 can include a network connection 304 enabling access to the Internet or a database (306) so that additional parameters can be considered for management of water flow. For example, based on forecasted weather conditions, soil humidity and historical evaporation levels, the pump (or pumps) and tanks may send water back to the pool 101 or to the irrigation system or back to the home.

In some embodiments as illustrated once again in FIG. 3, an integrated pool water flow and storage system 300 for a swimming pool 101 can include a water level sensor 201 for measuring at least threshold levels for a maximum evaporation level and for a maximum overflow level for water in the swimming pool 101, a first water storage tank 302 operatively coupled to the swimming pool 101, the first water storage tank having a water level sensor 301 for measuring a water level in the first water storage tank 302, and a water pump 204 operatively coupled to the first water storage tank 302. The system 300 can further include a second water storage tank 206 operatively coupled to the swimming pool 101 via the water pump 204 and an automatic water level control system 202 operatively coupled to the water level sensor 201 (an optionally 301) and the water pump 204, where the automatic water level control system 202 includes one or more processors coupled to memory having computer instructions stored therein (see FIG. 5). When the one or more processors execute the computer instructions, the one or more processors causes the one or more processors to perform one or more operations. In some embodiments, the one or more processors can send signals to the water pump 204 to pump water from the first water storage tank 302 to the pool 101 when the water level sensor detects a water level at or below the maximum evaporation level, send signals to the water pump 204 to pump water from the swimming pool 101 to the first water storage tank 302 when the water level sensor detects a water level at or above a maximum overflow level, and send signals to the water pump 204 to pump water from second water storage tank 206 to the first water storage tank 302 when the water level sensor in the first storage tank 302 falls below a predetermined threshold.

In some embodiments, the second water storage tank is arranged and constructed to receive water from a rooftop of an adjacent housing structure or from excess irrigation. In some embodiments, the second water storage tank is arranged and constructed to receive water from household wastewater sources. In yet other embodiments, a system can be configured to receive water from a number of sources including the rooftop, irrigation system excess, and from household waste water sources.

In some embodiments, the system 300 can further include a filtration system 308 and analyzer 309 coupled between the second water storage tank 206 and the water pump 204 and where the one or more processors is further programmed to send a signal to the water pump 204 to pump water from the second water storage tank 206 (or filtration system tank 308) when the water level sensor 301 in the first storage tank 302 falls below a predetermined threshold and the analyzer 309 detects that the water quality is above a predetermined threshold.

In some embodiments, the system 300 further includes a filtration system 308 and analyzer 309 coupled between the second water storage tank 310 and the water pump 204 and where the one or more processors (see 502 in FIG. 5) is further programmed to send a signal to the water pump to pump water 204 from the second water storage tank 310 (or 312) to a filtered water tank 314 when the water level sensor 301 in the first storage tank 302 falls below a predetermined threshold and the analyzer 311 (or 313) detects that the water quality in the second water storage tank (310 or 312) is above a predetermined threshold.

In some embodiments, the system 300 further includes a filtration system and analyzer (308/309 or 310/311 or 312/313) coupled between the second water storage tank and the water pump 204 and where the one or more processors is further programmed to send a signal to the water pump 204 to divert water from the second water storage tank (308 or 310 or 312) to a sewage pipe when the analyzer detects that the water quality in the second water storage tank is below a predetermined threshold.

In some embodiments, the system 300 further includes a network connection 304 for retrieving weather conditions, soil humidity level, and historical evaporation levels to intelligently analyze and manage water flow between the swimming pool, the first water storage tank, and the second water storage tank. Such weather, humidity and other data can come from Internet access or from a database (306). The network connection 304 can also optionally obtain data from level sensors (201, 301) and analyzers (309/311/313) to help make intelligent decisions concerning water flow.

In some embodiments, the system 300 further includes a filtration system 308 and analyzer 309 coupled between the second water storage tank 206 and the water pump 204 and where the one or more processors is further programmed to send a signal to the water pump 204 to pump water from the second water storage tank 206 when the water level sensor 301 in the first storage tank 302 falls below a predetermined threshold and the analyzer 309 detects that the water quality is above a predetermined threshold.

In some embodiments, the system 300 further includes a filtration system 312 and analyzer 313 (and/or 311) coupled between the second water storage tank (310 or 312) and the water pump 204 and where the one or more processors is further programmed to send a signal to the water pump 204 to pump water from the second water storage tank to a filtered water tank 314 when the water level sensor 301 in the first storage tank 302 falls below a predetermined threshold and the analyzer detects that the water quality in the second water storage tank is above a predetermined threshold.

In some embodiments, the system 300 further includes a filtration system and analyzer coupled between the second water storage tank and the water pump and where the one or more processors is further programmed to send a signal to the water pump 204 to divert water from the second water storage tank (308, 310 or 312) to a sewage pipe when the analyzer (309, 311 or 313) detects that the water quality in the second water storage tank is below a predetermined threshold.

In some embodiments, as shown in FIG. 2, the first water storage tank 102 is integrated and constructed underneath the swimming pool 101 to retain excess water from rain collected by the pool 101 to later compensate for water evaporation.

In some embodiments, the system 200 or 300 in a first case such as a rainy season mode stores excess water in at least one of the first water storage tank (102 or 302) and the second water storage tank (206 or 310).

In some embodiments, the system 200 or 300 in second case such as a dry season manages water between the swimming pool 101, an irrigation system, and household usage based on weather conditions, soil humidity and preset priorities.

For example, if the tank 206 (or 308) can hold one (1) month of irrigation capacity and if the water level in the pool 101 remains within the operational levels, then all extra water can be directed to irrigation or back to home usage or some other use.

The intelligent system should be able to manage water flow from the tank to the pool, or from tank to irrigation or from tank back to home based on weather conditions and the cost per gallon of water.

In some embodiments (with reference to FIGS. 2 and 3), an integrated pool water flow and storage system 200/300 for a swimming pool 101 can include a water level sensor 201 for measuring at least threshold levels for a maximum evaporation level and for a maximum overflow level for water in the swimming pool, a first water storage tank 102 or 302 operatively coupled to the swimming pool 101 where the first water storage tank is arrange and constructed underneath the swimming pool, a water pump 204 operatively coupled to the first water storage tank, a second water storage tank such as tank 206 operatively coupled to the swimming pool 101 via the water pump 204, and an automatic water level control system 202 operatively coupled to the water level sensor and the water pump, where the automatic water level control system 202 includes one or more processors coupled to memory having computer instructions stored therein. When executing the computer instructions, the one or more processors can causes the one or more operations including sending signals to the water pump 204 to pump water from the first water storage tank 102 or 302 to the pool 101 when the water level sensor 201 coupled to the swimming pool detects a water level at or below the maximum evaporation level and sending signals to the water pump to pump water from the swimming pool to the first water storage tank when the water level sensor coupled to the swimming pool detects a water level at or above a maximum overflow level.

In some embodiments, the first water storage tank 302 further includes a water level sensor 301 for measuring a water level in the first water storage tank 302.

In some embodiments, the one or more processors are further programmed to send signals to the water pump 204 to pump water from second water storage tank 206 to the first water storage tank 302 when the water level sensor 301 in the first storage tank falls below a predetermined threshold.

In some embodiments, the system further includes a filtration system 308 and analyzer 309 coupled between the second water storage tank 206 and the water pump 204 and where the one or more processors is further programmed to send a signal to the water pump 204 to pump water from the second water storage tank 206 when the water level sensor 301 in the first storage tank 301 falls below a predetermined threshold and the analyzer 309 detects that the water quality is above a predetermined threshold.

In some embodiments, the system further includes a filtration system 312 and analyzer 313 (or 311) coupled between the second water storage tank 310 and the water pump 204 and where the one or more processors is further programmed to send a signal to the water pump 204 to pump water from the second water storage tank 310 (or 312) to a filtered water tank 314 when the water level sensor 301 in the first storage tank 302 falls below a predetermined threshold and the analyzer 310 an/or 312 detects that the water quality in the second water storage tank 310 (or 312) is above a predetermined threshold.

In some embodiments, the system 300 further includes a filtration system and analyzer coupled between the second water storage tank and the water pump 204 and where the one or more processors is further programmed to send a signal to the water pump to divert water from the second water storage tank (308, 310 or 312) to a sewage pipe when the analyzer (309, 311 or 313) detects that the water quality in the second water storage tank is below a predetermined threshold.

In some embodiments, the system 300 further comprises a network connection 304 for retrieving weather conditions, soil humidity level, and historical evaporation levels to intelligently analyze and manage water flow between the swimming pool, the first water storage tank, and the second water storage tank and further includes at least one or more wireless transceivers (315*a*, 315*b*, 315*c*, 315*d*, 315*e*, 315*f*, and/or 315*g*) for transmitting data among the water level sensor or sensors, the automatic water level control system 202, and analyzer or analyzers.

Figure 4:
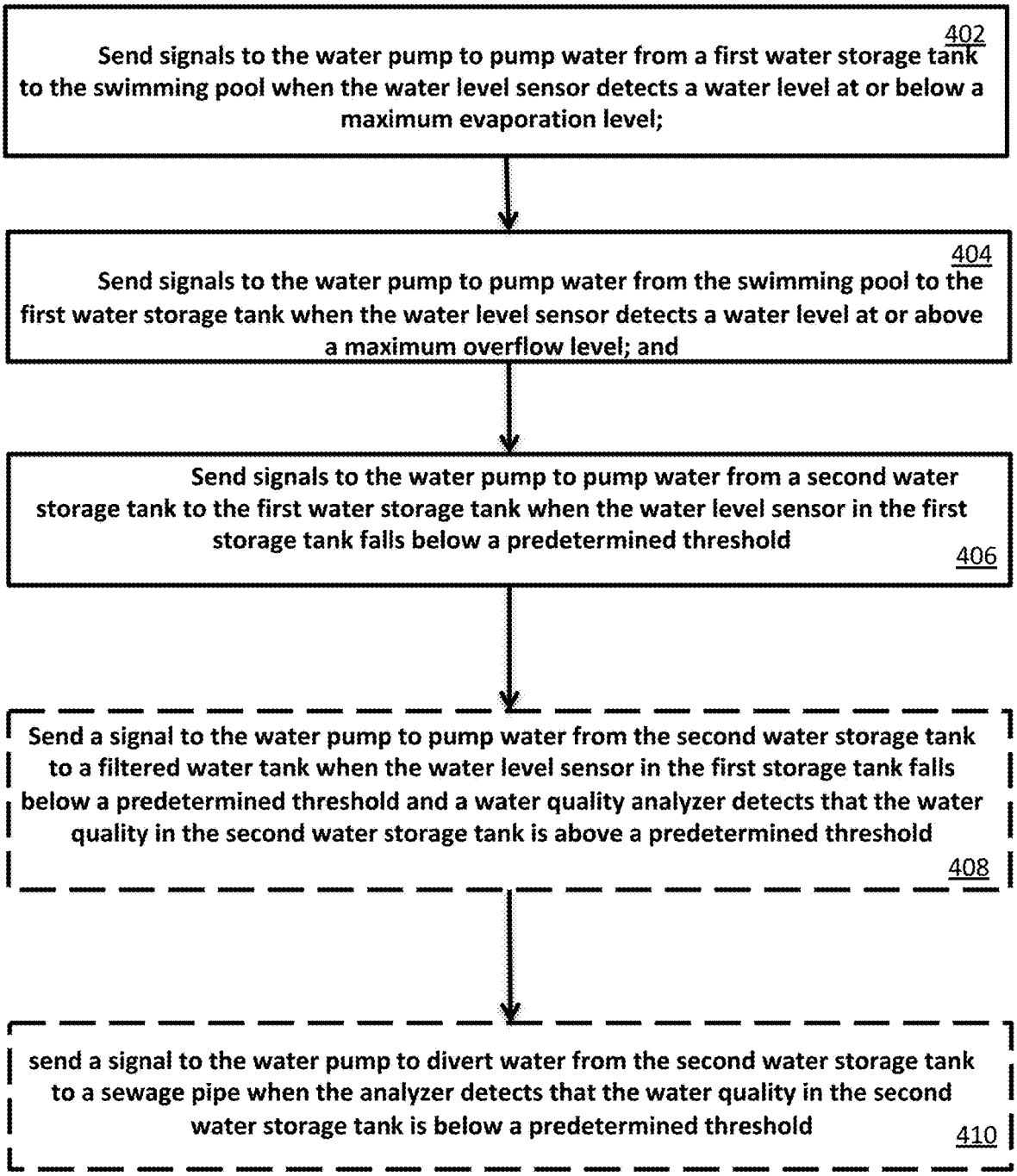
FIG. 4 further illustrates a method of evaporative loss compensation and water storage for a swimming pool using a pool water flow and storage system in accordance with the embodiments.

In some embodiments with reference to FIG. 4, a method 400 of evaporative loss compensation and water storage for a swimming pool having an automatic water level control system operatively coupled to a water level sensor for a swimming pool and a water pump, can include an automatic water level control system having one or more processors coupled to memory having computer instructions stored in the memory which when executed by the one or more processors causes the one or more processors to perform certain operations. Such operations can include the steps of sending signals at 402 to the water pump to pump water from a first water storage tank to the swimming pool when the water level sensor detects a water level at or below a maximum evaporation level, sending signals at 404 to the water pump to pump water from the swimming pool to the first water storage tank when the water level sensor detects a water level at or above a maximum overflow level, and sending signals at 406 to the water pump to pump water from a second water storage tank to the first water storage tank when the water level sensor in the first storage tank falls below a predetermined threshold.

In some embodiments, the method 400 can further include sending a signal at 408 to the water pump to pump water from the second water storage tank to a filtered water tank when the water level sensor in the first storage tank falls below a predetermined threshold and a water quality analyzer detects that the water quality in the second water storage tank is above a predetermined threshold. In some embodiments, the method 400 can include the step 410 of sending a signal to the water pump to divert water from the second water storage tank to a sewage pipe when the analyzer detects that the water quality in the second water storage tank is below a predetermined threshold.

Various embodiments of the present disclosure can be implemented on an information processing system. The information processing system is capable of implementing and/or performing any of the functionality set forth above. Any suitably configured processing system can be used as the information processing system in embodiments of the present disclosure. The information processing system is operational with numerous other general purpose or special purpose computing system environments, networks, or configurations. Examples of well-known computing systems, environments, and/or configurations that may be suitable for use with the information processing system include, but are not limited to, personal computer systems, server computer systems, thin clients, hand-held or laptop devices, notebook computing devices, multiprocessor systems, mobile devices, microprocessor-based systems, set top boxes, programmable consumer electronics, network PCs, minicomputer systems, mainframe computer systems, Internet-enabled television, and distributed cloud computing environments that include any of the above systems or devices, and the like. As noted previously, the data processing can be any number of data processing techniques suited for the management of water flow as contemplated herein.

For example, a user with a mobile device may be in communication with a server configured to implement the system using the aforementioned elements, according to an embodiment of the present disclosure. The mobile device can be, for example, a multi-modal wireless communication device, such as a "smart" phone, configured to store and execute mobile device applications ("apps"). Such a wireless communication device communicates with a wireless voice or data network using suitable wireless communications protocols assuming the networks have the appropriate bandwidth to present data or real time images. Alternatively, the display system can be a computing and monitoring system with or without wireless communications as the case may be. In some embodiments, the device or system can include a server and a tablet or laptop or other mobile computing device.

The system may include, inter alia, various hardware components such as processing circuitry executing modules that may be described in the general context of computer system-executable instructions, such as program modules, being executed by the system. Generally, program modules can include routines, programs, objects, components, logic, data structures, and so on that perform particular tasks or implement particular abstract data types. The modules may be practiced in various computing environments such as conventional and distributed cloud computing environments where tasks are performed by remote processing devices that are linked through a communications network. In a distributed cloud-computing environment, program modules may be located in both local and remote computer system storage media including memory storage devices. Program modules generally carry out the functions and/or methodologies of embodiments of the present disclosure, as described above.

In some embodiments, a system includes at least one memory and at least one or more processor of a computer system communicatively coupled to the at least one memory. The at least one processor can be configured to perform a method including methods described above.

According to yet another embodiment of the present disclosure, a computer readable storage medium comprises computer instructions which, responsive to being executed by one or more processors, cause the one or more processors to perform operations as described in the methods or systems above or elsewhere herein.

Figure 5:
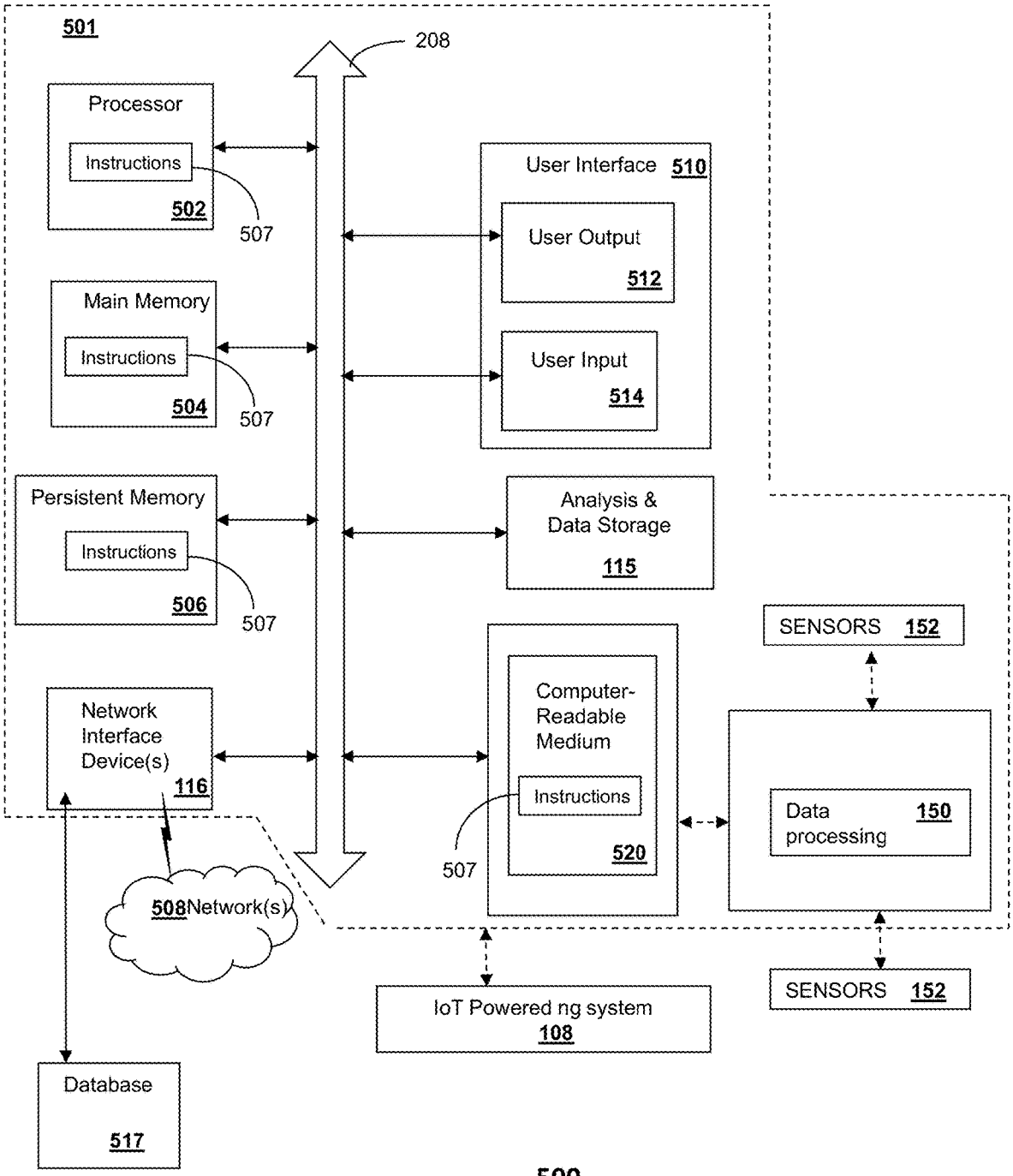
FIG. 5 illustrates a pool water flow and storage system in the form of a information processing device in accordance with the embodiments.

As shown in FIG. 5, an information processing system 501 of a system 500 can be communicatively coupled with the data processing module 150 and a group of client or other devices, or coupled to a presentation device for display at any location at a terminal or server location. According to this example, at least one processor 502, responsive to executing instructions 507, performs operations to communicate with the processing module 150 via a bus architecture 208, as shown. The at least one processor 502 is communicatively coupled with main memory 504, persistent memory 506, and a computer readable medium 520. The processor 502 is communicatively coupled with an Analysis & Data Storage 115 that, according to various implementations, can maintain stored information used by, for example, the data processing module 150 and more generally used by the information processing system 500. The data processing module 150 can be coupled to one or more sensors 152 as needed. Such sensors can be, temperature sensors, humidity sensors, pressure sensors, weight sensors or scales, location sensors, orientation sensors, microphones, cameras, video cameras, motion detectors, thermostats, biometric reading devices (e.g., iris scanners, facial recognition scanners, voice detection devices) and other devices as contemplated herein. Some sensors 152 can be part of the processor 501 itself or operatively coupled to the sensors 152 separate from the processor 501. Optionally, this stored information can be received from the client or other devices. For example, this stored information can be received periodically from the client devices and updated or processed over time in the Analysis & Data Storage 115. Additionally, according to another example, a history log can be maintained or stored in the Analysis & Data Storage 115 of the information processed over time. The data processing module 150, and the information processing system 500, can use the information from the history log such as in the analysis process and in making decisions related to generating forms or fields within forms according to a patient tracking system and patient status or according to a database of best practices for a particular procedure or procedures.

The computer readable medium 520, according to the present example, can be communicatively coupled with a reader/writer device (not shown) that is communicatively coupled via the bus architecture 208 with the at least one processor 502. The instructions 507, which can include instructions, configuration parameters, and data, may be stored in the computer readable medium 520, the main memory 504, the persistent memory 506, and in the processor's internal memory such as cache memory and registers, as shown.

The information processing system 500 includes a user interface (or interfaces) 510 that comprises a user output interface 512 and user input interface 514. Examples of elements of the user output interface 512 can include a display, a speaker, one or more indicator lights, one or more transducers that generate audible indicators, and a haptic signal generator or any of the interfaces illustrated or discussed with respect to the figures or elsewhere in the application. Examples of elements of the user input interface 514 can include a keyboard, a keypad, a mouse, a track pad, a touch screen, a touch pad, a microphone that receives audio signals, a camera, a video camera, a CT-Scanner, or any other scanner that scans images. Some user inputs can be sensors or vice-versa. The received audio signals or scanned images, for example, can be converted to electronic digital representations and stored in memory, and optionally can be used with corresponding voice or image recognition software executed by the processor 502 to receive user input data and commands, or to receive test data for example.

A network interface device 116 is communicatively coupled with the at least one processor 502 and provides a communication interface for the information processing system 501 and any linked IoT Powered system 108 to communicate via one or more networks 508. The networks 508 can include wired and wireless networks, and can be any of local area networks, wide area networks, or a combination of such networks. For example, wide area networks including the internet and the web can inter-communicate the information processing system 501 with other one or more information processing systems that may be locally, or remotely, located relative to the information processing system 501. It should be noted that mobile communications devices, such as mobile phones, Smart phones, tablet computers, lap top computers, and the like, which are capable of at least one of wired and/or wireless communication, are also examples of information processing systems within the scope of the present disclosure. The network interface device 116 can provide a communication interface for the information processing system 500 to access the at least one database 517 according to various embodiments of the disclosure.

The instructions 507, according to the present example, can include instructions for monitoring, instructions for analyzing, instructions for retrieving and sending information and related configuration parameters and data that would enable and facilitate an IoT powered system. It should be noted that any portion of the instructions 507 can be stored in a centralized information processing system or can be stored in a distributed information processing system, i.e., with portions of the system distributed and communicatively coupled together over one or more communication links or networks.

FIGS. 1-6 illustrate examples of systems (100, 200 or 300), methods (500) or process flows, according to various embodiments of the present disclosure, which can operate in conjunction with the information processing system 500 of FIG. 7.

In some embodiments with reference to any of the embodiments, the various components can be arranged and configured to be in any number of parameters, positions and sizes as required for a particular embodiment. Some embodiments with smaller dimensions or parameters would likely be better suited for portable embodiments. For example, in a number of embodiments the forms 110 can be of any number of forms, not just the ones shown.

In interpreting the present disclosure and the claims, references of the form "A and/or B" encompass any and every combination and subcombination of the elements A and B, namely any or all of the following: (i.) A, (ii.) B, (iii.) A or B, and (iv.) A and B. References of the form "A, B, and/or C" likewise encompass any and every combination and subcombination of elements A, B, and C). Where the present disclosure or any of the claims may recite "a" or "a first" item or the equivalent thereof, such disclosure includes one or more such items and does not require or exclude two or more such items. Numerical or ordinal terms such as "first", "second", "third" etc. when used to refer to items are used solely to identify the items, and do not require or limit the number of such items elements and do not indicate, require or limit a particular position or order of such items unless expressly and clearly stated otherwise.

Descriptions made with reference to "embodiment", "embodiments", "some embodiments", "an embodiment", "preferred embodiment", "other embodiments", "alternative embodiments", "various embodiments" or the like mean that the description is applicable to at least one embodiment but not necessarily all embodiments. The terms "comprising", "including", "having", and the like, as used with respect to one or more embodiments, are synonymous. In some cases features, items steps or other subject matter are described herein as being optional or using terms such as "optional" or "optionally". However, lack use of such terms in connection with the description of any other features, items steps or other subject matter does not in any way mean or imply that such other features, items steps or other subject matter are required or are not optional.

As an aid to understanding, various actions, operations or steps may sometimes be presented herein or described herein in sequence. However, the order of the description or written presentation herein is not to be construed to mean or imply that such must necessarily occur in a corresponding order or sequence unless otherwise expressly and clearly stated or logically essential. Some actions, operations or steps may permissibly be performed in an order or sequence other than the order of their description or written presentation herein unless otherwise expressly and clearly stated or logically essential. Unless otherwise expressly and clearly stated or logically essential. Unless otherwise expressly and clearly state or logically essential, actions, operations or steps described herein may be combined or divided. Unless otherwise expressly and clearly stated or logically essential, any description herein of any one or more actions, operations or steps does not preclude any one or more other preceding, succeeding and/or intervening actions, operations or steps irrespective of whether or not such preceding, succeeding and/or intervening actions, operations or steps are described or disclosed herein.

Unless otherwise expressly and clearly stated or logically essential, any illustration, description, or reference herein of any one or more items, structures or elements being "connected to", "coupled to", "joined to", "joined with", "attached to", "mounted to", "mounted in", or "secured to" any one or more other specified items, structures or elements shall not be construed to preclude such connection, coupling, joint, attachment, mounting or securement being either made indirectly, by way of one or more other specified or unspecified items structures or elements, or being made directly.

Unless otherwise expressly and clearly stated or logically essential, any illustration, description, or reference herein of any one or more items, structures, or elements "adjoining", any one or more other specified items, structures or elements, shall be construed to permit that such may adjoin either direct or indirectly. The term "adjoining" permits, but does not require, preclude the presence of items, structures or elements interposed between those describes as adjoining. Unless otherwise expressly and clearly stated or logically essential, any illustration, description, or reference herein to any one or more items, structures or elements being "beneath", "below", "above", "behind", "in front of", "between", "under", "over", "in", "within", "outside", "inside", any one or more other specified items, structures or elements and/or any other prepositions or prepositional phrases shall construed in a manner which permits, but does not require, contact or immediacy and any and all other prepositions and/or prepositional phrases shall be construed in that same manner.

While the embodiments have been described with reference to various preferred embodiments, it will be understood by those skilled in the art that various changes may be made and equivalents substituted for elements thereof without departing from the scope of the embodiments and that modifications may be made to adapt to a particular situation or application of the embodiments without departing from the scope. The embodiments within the scope of the claims are not limited to the particular embodiments disclosed. Rather, the claims cover all embodiments which are within the scope of the claims, either literally or under the Doctrine of Equivalents.

The invention claimed is:

1. An integrated pool water flow and storage system for a swimming pool, comprising:

a water level sensor for measuring at least threshold levels for a maximum evaporation level and for a maximum overflow level for water in the swimming pool;

a first water storage tank operatively coupled to the swimming pool, the first water storage tank having a water level sensor for measuring a water level in the first water storage tank;

a water pump operatively coupled to the first water storage tank;

a second water storage tank operatively coupled to the swimming pool via the water pump; and an automatic water level control system operatively coupled to the water level sensor and the water pump, wherein the automatic water level control system includes one or more processors coupled to memory having computer instructions stored therein which when executed by the one or more processors causes the one or more processors to:

send signals to the water pump to pump water from the first water storage tank to the pool when the water level sensor detects a water level at or below the maximum evaporation level;

send signals to the water pump to pump water from the swimming pool to the first water storage tank when the water level sensor detects a water level at or above a maximum overflow level; and send signals to the water pump to pump water from second water storage tank to the first water storage tank when the water level sensor detects that the water level in the first storage tank falls below a predetermined threshold.

2. The system of claim 1, wherein the second water storage tank is arranged and constructed to receive water from a rooftop of an adjacent housing structure or from excess irrigation.

3. The system of claim 1, wherein the second water storage tank is arranged and constructed to receive water from household wastewater sources.

4. The system of claim 1, wherein the system further comprises a filtration system and analyzer coupled between the second water storage tank and the water pump and wherein the one or more processors is further programmed to send a signal to the water pump to pump water from the second water storage tank when the water level sensor detects that the water level in the first storage tank falls below a predetermined threshold and the analyzer detects that the water quality is above a predetermined threshold.

5. The system of claim 1, wherein the system further comprises a filtration system and analyzer coupled between the second water storage tank and the water pump and wherein the one or more processors is further programmed to send a signal to the water pump to pump water from the second water storage tank to a filtered water tank when the water level sensor detects that the water level in the first storage tank falls below a predetermined threshold and the analyzer detects that the water quality in the second water storage tank is above a predetermined threshold.

6. The system of claim 1, wherein the system further comprises a filtration system and analyzer coupled between the second water storage tank and the water pump and wherein the one or more processors is further programmed to send a signal to the water pump to divert water from the second water storage tank to a sewage pipe when the analyzer detects that the water quality in the second water storage tank is below a predetermined threshold.

7. The system of claim 1, wherein the system further comprises a network connection for retrieving weather conditions, soil humidity level, and historical evaporation levels to analyze and manage water flow between the swimming pool, the first water storage tank, and the second water storage tank.

8. The system of claim 4, wherein the one or more processors is further programmed to send a signal to the water pump to pump water from the second water storage tank when the water level sensor detects that the water level in the first storage tank falls below a predetermined threshold and the analyzer detects that the water quality is above a predetermined threshold.

9. The system of claim 4, wherein the one or more processors is further programmed to send a signal to the water pump to pump water from the second water storage tank to a filtered water tank when the water level sensor detects that the water level in the first storage tank falls below a predetermined threshold and the analyzer detects that the water quality in the second water storage tank is above a predetermined threshold.

10. The system of claim 4, wherein the one or more processors is further programmed to send a signal to the water pump to divert water from the second water storage tank to a sewage pipe when the analyzer detects that the water quality in the second water storage tank is below a predetermined threshold.

11. The system of claim 1, wherein the first water storage tank is integrated and constructed underneath the swimming pool to retain excess water from rain collected by the pool to later compensate for water evaporation.

12. The system of claim 1, wherein the system in a rainy season mode stores excess water in at least one of the first water storage tank and the second water storage tank.

13. The system of claim 1, wherein the system in a dry season manages water between the swimming pool, an irrigation system, and household usage based on weather conditions, and soil humidity.

14. An integrated pool water flow and storage system for a swimming pool, comprising:

a water level sensor for measuring at least threshold levels for a maximum evaporation level and for a maximum overflow level for water in the swimming pool;

a first water storage tank operatively coupled to the swimming pool, wherein the first water storage tank is arranged and constructed underneath the swimming pool;

a water pump operatively coupled to the first water storage tank;

a second water storage tank operatively coupled to the swimming pool via the water pump; and an automatic water level control system operatively coupled to the water level sensor and the water pump, wherein the automatic water level control system includes one or more processors coupled to memory having computer instructions stored therein which when executed by the one or more processors causes the one or more processors to:

send signals to the water pump to pump water from the first water storage tank to the pool when the water level sensor coupled to the swimming pool detects a water level at or below the maximum evaporation level; and send signals to the water pump to pump water from the swimming pool to the first water storage tank when the water level sensor coupled to the swimming pool detects a water level at or above a maximum overflow level.

15. The system of claim 14, wherein the first water storage tank further includes a water level sensor for measuring a water level in the first water storage tank.

16. The system of claim 15, wherein the system further comprises a filtration system and analyzer coupled between the second water storage tank and the water pump and wherein the one or more processors is further programmed to send a signal to the water pump to pump water from the second water storage tank when the water level sensor detects that the water level in the first storage tank falls below a predetermined threshold and the analyzer detects that the water quality is above a predetermined threshold.

17. The system of claim 15, wherein the system further comprises a filtration system and analyzer coupled between the second water storage tank and the water pump and wherein the one or more processors is further programmed to send a signal to the water pump to pump water from the second water storage tank to a filtered water tank when the water level sensor detects that the water level in the first storage tank falls below a predetermined threshold and the analyzer detects that the water quality in the second water storage tank is above a predetermined threshold.

18. The system of claim 15, wherein the system further comprises a filtration system and analyzer coupled between the second water storage tank and the water pump and wherein the one or more processors is further programmed to send a signal to the water pump to divert water from the second water storage tank to a sewage pipe when the analyzer detects that the water quality in the second water storage tank is below a predetermined threshold.

19. A method of integrated pool water flow and water storage for a swimming pool having an automatic water level control system operatively coupled to a water level sensor for measuring at least threshold levels for a maximum evaporation level and for a maximum overflow level for water in the swimming pool, a first water storage tank operatively coupled to the swimming pool, the first water storage tank having a water level sensor for measuring a water level in the first water storage tank, a water pump operatively coupled to the first water storage tank, and a second water storage tank operatively coupled to the swimming pool via the water pump; and wherein the automatic water level control system includes one or more processors coupled to memory having computer instructions stored therein which when executed by the one or more processors causes the one or more processors to perform the operations comprising of:

sending signals to the water pump to pump water from the first water storage tank to the swimming pool when the water level sensor detects a water level at or below a maximum evaporation level;

sending signals to the water pump to pump water from the swimming pool to the first water storage tank when the water level sensor detects a water level at or above a maximum overflow level; and sending signals to the water pump to pump water from the second water storage tank to the first water storage tank when the water level sensor detects that the water level in the first storage tank falls below a predetermined threshold.

20. The method of claim 19, wherein the one or more processors are further programmed when the water level sensor in the first storage tank falls below a predetermined threshold and a water quality analyzer detects that the water quality in the second water storage tank is above a predetermined threshold to send a signal to the water pump to pump water from the second water storage tank to a filtered water tank and further to send a signal to the water pump to divert water from the second water storage tank to a sewage pipe when the analyzer detects that the water quality in the second water storage tank is below a predetermined threshold.

* * * * *